US009396846B2

(12) United States Patent
Fausz

(10) Patent No.: US 9,396,846 B2
(45) Date of Patent: Jul. 19, 2016

(54) METHOD OF POST-TWINNING DUAL SOLID FOAMED INSULATION

(75) Inventor: David M. Fausz, Fort Thomas, KY (US)

(73) Assignee: General Cable Technologies Corporation, Highland Heights, KY (US)

( * ) Notice: Subject to any disclaimer, the term of this patent is extended or adjusted under 35 U.S.C. 154(b) by 1160 days.

(21) Appl. No.: 12/948,282

(22) Filed: Nov. 17, 2010

(65) Prior Publication Data

US 2011/0117270 A1 May 19, 2011

Related U.S. Application Data

(60) Provisional application No. 61/262,350, filed on Nov. 18, 2009.

(51) Int. Cl.

| | |
|---|---|
| ***B05D 7/20*** | (2006.01) |
| ***H01B 13/14*** | (2006.01) |
| ***H01B 3/44*** | (2006.01) |

(52) U.S. Cl.

CPC ..... *H01B 13/145* (2013.01); *H01B 3/441* (2013.01); *H01B 3/445* (2013.01); *H01B 13/148* (2013.01); *B05D 7/20* (2013.01)

(58) Field of Classification Search

USPC ..... 427/119, 120; 174/110 R, 113 R

See application file for complete search history.

(56) References Cited

U.S. PATENT DOCUMENTS

| | | | | |
|---|---|---|---|---|
| 3,365,353 | A * | 1/1968 | Witman | 428/159 |
| 6,222,129 | B1 * | 4/2001 | Siekierka et al. | 174/113 R |
| 7,105,749 | B2 * | 9/2006 | Belli et al. | 174/110 R |
| 7,473,848 | B2 * | 1/2009 | Kenny et al. | 174/110 R |

FOREIGN PATENT DOCUMENTS

| | | | |
|---|---|---|---|
| JP | 11-203941 | * | 7/1999 |
| JP | 2002-214491 | * | 7/2001 |

* cited by examiner

*Primary Examiner* — Brian K Talbot

(74) *Attorney, Agent, or Firm* — Ulmer & Berne LLP

(57) ABSTRACT

The present invention relates to a method for making wire insulation that comprises the steps of providing a solid insulative material; adding a chemical foaming agent to at least one section of the solid insulative material; extruding the solid insulative material over at least one wire to create an insulated wire; and heating the insulated wire after extruding the solid insulative material and activating the chemical foaming agent in the at least one section of the solid insulative material to create at least one foamed section in the solid insulative material.

22 Claims, 1 Drawing Sheet

METHOD OF POST-TWINNING DUAL SOLID FOAMED INSULATION

RELATED APPLICATION

This application claims priority under 35 U.S.C. §119(e) to U.S. Provisional Application Ser. No. 61/262,350, filed on Nov. 18, 2009, the subject matter of which is herein incorporated by reference.

FIELD OF THE INVENTION

The present invention relates to wire insulation, such as for twisted insulated wire pairs used in data cables, and a method for making the same. More specifically, the invention relates to providing both solid and foamed insulation after twinning the wire pairs.

BACKGROUND OF THE INVENTION

Data cables typically include a core of twisted wire pairs with each individual wire being insulated. When foam insulation is used, crushing often occurs when the wire pairs are twinned or twisted together which can result in an unwanted reduction in conductor-to-conductor spacing. That is because foam is physically weaker in tensile and compressive strength than solid insulation. Also, in current foaming methods, it is often difficult to control foam percentages within the extrusion operation due to a multitude of factors, such as back pressure, melt strength, and catalyst integration. In addition, during normal extrusion processes, such as pressure extrusion, it is not possible to vary the shape of the insulation of the conductor. That is because pressure extrusion makes adding channels and shapes very difficult around wires. Solid insulation may be used, however, it is typically more expensive and often fails flame testing because it generates much more smoke than foamed materials.

SUMMARY OF THE INVENTION

Accordingly, the present invention provides a method for making wire insulation that comprises the steps of providing a solid insulative material; adding a chemical foaming agent to at least one section of the solid insulative material; extruding the solid insulative material over at least one wire to create an insulated wire; and heating the insulated wire and activating the chemical foaming agent in the at least one section of the solid insulative material to create a foamed section in the solid insulative material.

The present invention also provides a method for making wire insulation, comprising the steps of providing a solid insulative material; adding a chemical foaming agent to at least one section of the solid insulative material; extruding the solid insulative material over two wires to create first and second insulated wires; and heating the first and second insulated wires and activating the chemical foaming agent in the at least one section of the solid insulative material to create a foamed section in the solid insulative material in at least one of the first and second insulated wires.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

The method of the present invention mitigates the problems of conventional wire insulation by allowing a stronger solid compound to be utilized prior to twinning of the wire pairs while gaining the benefit of foam insulation post-twinning. The method of the present invention leverages higher compressive strength materials in the twinning process while creating lower compressive attributes post twinning. In addition, the invention reduces fuel load, thus improving the flame and smoke characteristics by creating air pockets where compound once existed. Also, certain electrical characteristics, such as dissipation factor, attenuation, and capacitance are improved by use of insulation that has minimal crush.

Figure 2:
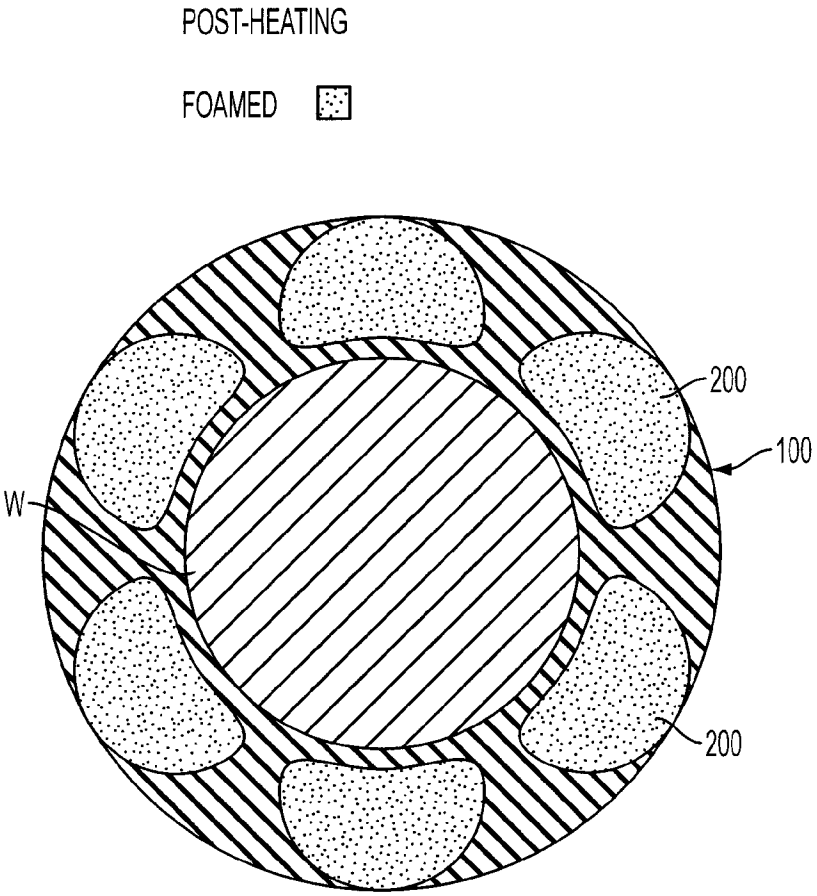
FIG. 2 is a cross-sectional view of the insulated wire of FIG. 1 made according to the present method post heating.
Figure 1:
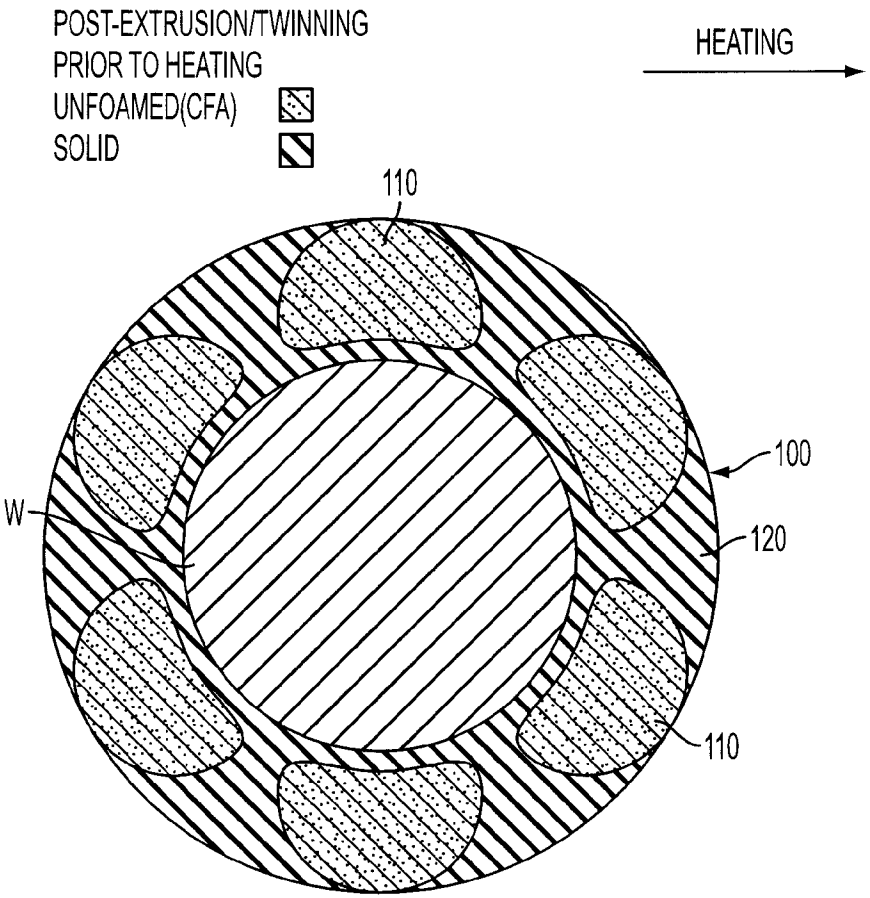
FIG. 1 is a cross-sectional view of an insulated wire of a wire pair made according to the present method prior to heating.

Referring to FIGS. 1 and 2, the method of making the wire insulation 100 according to an exemplary embodiment of the present invention includes using one or more solid compounds in a dual extrusion process for insulating a wire. Exemplary materials that may be used for the insulation 100 include fluorinated ethylene propylene (FEP), high density polyethylene (HDPE), perfluoromethylvinylether (MFA), Halar, polyvinyl chloride (PVC), other fluoropolymers and the like. A high-temperature foaming agent or CFA (Chemical Foaming Agent) 110 may be added to one of the solid compounds 120 or portions of the insulation 100, as illustrated in FIG. 1. Exemplary CFAs may include substituted Hyrdrazides, substituted azo compounds, substituted nitroso compounds, Azodicarbonamide, Sulfohydrazide, Sodium Bicarbonate, and the like.

After the insulation 100 is applied to a wire W via the extrusion process, the individual insulated wires are twinned/paired together. The wire pairs are subsequently subjected to heating (via any known device that creates an elevated temperature within the material) activating the CFA 110 resulting in foamed sections 200 of the wire insulation 100, as seen in FIG. 2. Thus the insulation 100 having both foamed and solid sections is not fully realized until after the pairs have been constructed i.e. twinned. The insulation 100 is preferably 80% foam and 20% solid. Such percentages, however, may vary +/−15%. However, the insulation 100 may be any desired mixture of foam and solid by percentage. Because the insulation 100 is foamed after twinning of the wire pairs, the crushing of the insulation that occurs during the twinning process is substantially eliminated.

The CFA 110 is preferably applied within selected areas of the insulation 100, as illustrated in FIG. 1, and may be applied within the insulation 100 randomly or uniformly. Also, the CFA 110 may be applied as a coating on the outer surface of the insulation, while the inner layer of the insulation remains solid.

The method of the present invention also allows control of the amount of foaming in the insulation via the heating operation. That is, the amount of activation of the CFA 110 is controlled via the heat applied. That has many advantages, including better impedance control, the ability to vary foaming to mitigate cyclical defects, and tuning the velocity of propagation within different lay pairs within a cable.

By utilizing a catalyst or CFA in certain regions of the insulated wire, it becomes possible to alter the shape of the insulation 100 via the expansion of materials in those regions. That has the advantage of creating desired physical characteristics that could aid when connecting the insulated wires to components. For example, the method according to the present invention may be used to create a groove in the insulation 100. The groove is created by the application of heat which activates the CFA to produce foam which ultimately collapses or shrinks back to form the groove. That groove could match up with a notch in the connector making it a better and easier connection.

Certain insulation shapes may also be created in accordance with the present method that would not be possible during conventional extrusion processes. For example, the present method contemplates the step of using an ink to prevent certain regions of the insulative material from foaming. More specifically, the ink is applied to select areas where it is desired for the region to remain solid. When the foaming agent or CFA begins to react, the foaming will only be activated in those areas that do not include the added ink. Thus, the shape of the insulation of the conductor can be controlled when the foaming agent is activated and the ink saturated areas remain unfoamed. That is helpful in maintaining certain physical characteristics, such as tensile strength and elongation. It can also help allow for certain surfaces to remain non-porous, thus allowing for better resistance to moisture migration. Application of the ink may also be used for markings and identification on the insulation 100 not possible with existing extrusion techniques. Exemplary inks may include free radical catalysts widely used to enhance polymerization of olefinically unsaturated compounds. They may comprise primarily the organic per-compounds. Peroxides are also usable, such as di-t-butyl peroxide, benzoyl peroxide, lauroyl peroxide, capryloyl peroxide, acetyl peroxide, p-chloro-benzoyl peroxide, cumene hydroperoxide, and other known peroxide initiators. Other per-compounds such as t-butyl perbenzoate, and isopropylpercarbonate are usable as inks. Azocatalysts, such as alpha,alpha'-azodiisobutyronitrile, may also be used.

The method may also include the step of randomized twisting of each insulated wire to help reduce crushing. For example, each insulated wire can be backtwisted before the wires are formed into a twisted pair. The method may also include the ability to employ different degrees of post twinning foaming to solve such issues as delay skew caused by different twist lays. In other words, the insulation 100 could be foamed differently at different levels and concentrations along the length of the wire pair. That would be accomplished by heating different sections of the wire pairs at different temperatures and changing the activation of the CFA.

The method of the present invention may also include creating some sticking between the insulated wires within a pair during the application of heat. That aids in certain electrical characteristics, such as reducing return loss.

The method has the further advantage of allowing the use of materials that are considered non-melt flow materials, such as polytetrafluoroethylene (PTFE). Also, processes, such as injection molding, do not allow for foaming. However, injection molding can be used by adding the CFA 110 to the compound that is later activated via heat.

Because foaming of the insulation occurs after twisting the wire pairs together, no additional insulation crushing occurs, thereby providing the potential advantage of allowing higher foam rates not possible at single wire extrusion. Another advantage of the present method is the ability to choose how much agent is activated post twinning, allowing for the tuning of electrical performance in varying process conditions. For example, heat may be used in varying amounts to control how much the foam is kicked off or activated, thereby allowing for tuning. That is because by foaming in certain amounts, the benefit of air is added to the insulation, which is the best dielectric constant. And with the present method, it is possible to change the air content of the insulation after extruding the insulation over the wires to tune towards desired properties post extrusion.

While particular embodiments have been chosen to illustrate the invention, it will be understood by those skilled in the art that various changes and modifications can be made therein without departing from the scope of the invention as defined in the appended claims.

What is claimed is:

1. A method for making wire insulation, comprising the steps of:

providing a solid insulative material;

adding a chemical foaming agent to at least one section of the solid insulative material;

extruding the solid insulative material over at least one wire to create an insulated wire;

twisting the insulated wire prior to heating the insulated wire; and heating the insulated wire after extruding the solid insulative material and after twisting the insulated wire, and activating the chemical foaming agent in the at least one section of the solid insulative material to create at least one foamed section in the solid insulative material.

2. A method according to claim 1, further comprising the step of:

adding the chemical foaming agent to a plurality of sections of the solid insulative material to create a plurality of foamed sections in the solid insulative material after extruding the solid insulative material.

3. A method according to claim 2, wherein the plurality of foamed sections make up about 80% of the insulative material.

4. A method according to claim 1, further comprising the step of:

adding the chemical foaming agent to substantially all of the solid insulative material.

5. A method according to claim 1, further comprising the step of:

adding an ink to a select region of the solid insulative material to prevent the select region from foaming when heating the insulated wire.

6. A method according to claim 5, wherein the select region provides identification of the wire.

7. A method according to claim 5, wherein the ink is one of a free radical catalyst, organic per-compounds, peroxides, or azocatayst.

8. A method according to claim 1, further comprising the step of adjusting the amount of chemical foaming agent in the insulative material to tune the electrical properties of the wire.

9. A method according to claim 1, further comprising the step of:

creating a groove in an outer surface of the solid insulative material after activating the chemical foaming agent.

10. A method according to claim 1, wherein the solid insulative material is one of a FEP, HDPE, MFA, Halar, PVC, or fluoropolymer.

11. A method according to claim 1, wherein the chemical foaming agent is one of substituted hyrdrazides, substituted azo compounds, substituted nitroso compounds, azodicarbonamide, sulfohydrazide, or sodium bicarbonate.

12. A method according to claim 1, further comprising the step of applying the chemical foaming agent as a coating over the solid insulative material.

13. A method for making wire insulation, comprising the steps of:

providing a solid insulative material;

adding a chemical foaming agent to at least one section of the solid insulative material;

extruding the solid insulative material over first and second wires to create first and second insulated wires;

twinning the first and second insulated wires in a twisted wire pair prior to heating the insulated wires; and heating the first and second insulated wires after extruding the solid insulative material over the first and second wires and after twinning the first and second insulated wires, and activating the chemical foaming agent in the at least one section of the solid insulative material to create at least one foamed section in the solid insulative material in at least one of the first and second insulated wires.

14. A method according to claim 13, further comprising the step of:

twisting each of the first and second insulated wires.

15. A method according to claim 13, further comprising the step of:

adding the chemical foaming agent to a plurality of sections of the solid insulated material to create a plurality of foamed sections in the solid insulative material of at least one of the first and second insulated wires.

16. A method according to claim 15, wherein the plurality of foamed sections make up about 80% of the insulative material.

17. A method according to claim 13, further comprising the step of:

adding the chemical foaming agent to substantially all of the solid insulative material.

18. A method according to claim 13, further comprising the step of:

adding an ink to a select region of the solid insulative material to prevent the select region from foaming.

19. A method according to claim 13, further comprising the step of:

adjusting the amount of chemical foaming agent in the insulation to tune the electrical properties of the wire.

20. A method according to claim 13, wherein the solid insulative material is one of a FEP, HDPE, MFA, Halar, PVC, or fluropolymer.

21. A method according to claim 13, further comprising the step of creating a groove in an outer surface of the solid insulative material after activating the chemical foaming agent.

22. A method according to claim 13, further comprising the step of applying the chemical foaming agent as a coating over the solid insulative material.

* * * * *